US011136832B2

(12) United States Patent
Halim et al.

(10) Patent No.: US 11,136,832 B2
(45) Date of Patent: Oct. 5, 2021

(54) THREAD PROTECTOR FOR USE WITH SUCKER RODS AND OIL TOOLS

(71) Applicant: UNIARMOUR LLC, Houston, TX (US)

(72) Inventors: Hazem Abdel Halim, Houston, TX (US); Alessandro Caccialupi, Houston, TX (US)

( * ) Notice: Subject to any disclaimer, the term of this patent is extended or adjusted under 35 U.S.C. 154(b) by 194 days.

(21) Appl. No.: 16/017,490

(22) Filed: Jun. 25, 2018

(65) Prior Publication Data

US 2019/0003263 A1 Jan. 3, 2019

Related U.S. Application Data

(60) Provisional application No. 62/526,042, filed on Jun. 28, 2017.

(51) Int. Cl.

| | |
|---|---|
| ***F16L 57/00*** | (2006.01) |
| ***E21B 17/00*** | (2006.01) |
| ***E21B 17/10*** | (2006.01) |
| *E21B 43/12* | (2006.01) |

(52) U.S. Cl.
CPC ..... *E21B 17/006* (2013.01); *E21B 17/1071* (2013.01); *E21B 43/126* (2013.01)

(58) Field of Classification Search
CPC ... E21B 17/006; E21B 17/1071; E21B 43/126
USPC ..... 138/96 R, 96 T
See application file for complete search history.

(56) References Cited

U.S. PATENT DOCUMENTS

| | | | | |
|---|---|---|---|---|
| 2,082,144 | A | 6/1937 | Bowers | |
| 2,133,049 | A | 10/1938 | Shimer | |
| 2,316,013 | A * | 4/1943 | Mulholland | B65D 59/02 138/96 T |
| 2,378,710 | A | 6/1945 | Krause | |
| 2,930,409 | A | 8/1956 | Higgins | |
| 2,873,765 | A | 2/1959 | Gregory | |
| 2,930,118 | A | 3/1960 | Higgins | |
| 4,005,735 | A * | 2/1977 | Miyamoto | F16L 15/008 138/96 R |
| 4,342,337 | A | 8/1982 | Underwood | |
| 4,429,719 | A * | 2/1984 | Mosing | B65D 59/06 138/89 |

(Continued)

OTHER PUBLICATIONS

International Search Report and Written Opinion of the ISA for corresponding PCT/US19/37016.

*Primary Examiner* — James F Hook
(74) *Attorney, Agent, or Firm* — Egbert, McDaniel & Swartz

(57) ABSTRACT

A thread protector for use on a sucker rod or a drill pipe has a collet with a plurality of collet segments in which each of the plurality of collet segments has a protrusion adjacent an end thereof, and a sleeve overlying the collet and movable between a first position and a second position. The second position compresses the plurality of collet segments such that the protrusion engages with the thread relief of the sucker rod or drill pipe. This retains the sleeve and the plurality of collet segments over the threaded end of the pipe so as to protect the threaded end of the pipe. The sleeve is movable to the first position such that the protrusions of the plurality of collet segments release from the thread relief so as to allow the thread protector to be removed from the threaded end of the pipe.

17 Claims, 5 Drawing Sheets

(56) References Cited

U.S. PATENT DOCUMENTS

| | | | | |
|---|---|---|---|---|
| 4,566,168 | A | 1/1986 | Stromberg | |
| 4,757,595 | A | 7/1988 | Fraering, Jr. | |
| 5,676,174 | A * | 10/1997 | Berneski, Jr. ..... | F16L 55/1108 138/89 |
| 5,813,104 | A | 9/1998 | Quick | |
| 5,819,805 | A | 10/1998 | Mosing et al. | |
| 5,908,048 | A | 6/1999 | Van Driel | |
| 6,474,411 | B1 | 11/2002 | Castro | |
| 8,342,210 | B2 * | 1/2013 | Vachon ..... | F16L 55/1157 138/89 |
| 9,567,815 | B2 * | 2/2017 | Latiolais, Jr. ..... | E21B 19/06 |
| 2007/0113910 | A1 | 5/2007 | Pagura et al. | |
| 2012/0061528 | A1 * | 3/2012 | Roth ..... | E21B 19/10 248/65 |
| 2012/0312411 | A1 | 12/2012 | Lubbers | |
| 2018/0135792 | A1 | 5/2018 | Halim et al. | |

* cited by examiner

THREAD PROTECTOR FOR USE WITH SUCKER RODS AND OIL TOOLS

CROSS-REFERENCE TO RELATED APPLICATIONS

The present application claims priority from U.S. Provisional Patent Application Ser. No. 62/526,042, filed on Jun. 28, 2017, and entitled "Sucker Rod Thread Protector".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to thread protectors for the threads of sucker rods and oil tools. More particularly, the present invention relates to a threadless thread protector which can be installed efficiently and locked in place.

2. Description of Related Art Including Information Disclosed Under 37 CFR 1.97 and 37 CFR 1.98

Sucker rods are primarily used for the artificial lift of hydrocarbons out of oil wells. Once a well has been producing for a period of time, a drop in reservoir pressure prevents hydrocarbons from being produced naturally. Therefore, an artificial lift is used so as to be able to remove as many hydrocarbons as possible from the reservoir. One of the main forms of artificial lift consists of a pumping unit at the surface, a downhole pump, and sucker rods connecting the surface unit to the downhole pump. The sucker rods have a circular body or midsection with two externally threaded ends (also known as "pin threads"). The rods are connected to each other by means of a coupling of a short length and with two female threads (also known as "box threads").

The ends of the rods, including the threads, are subject to damage when not in actual use. This damage can result from corrosion, impacts with other objects, or as a result of being dropped during transportation and/or storage. This damage may render the rod faulty or unusable. This can result in delay, hardship and increased expense to the well operator. Devices known as thread protectors are commonly used to protect the ends of rods, and in particular, to protect the external threads on the ends. A pin end thread protector is connected to and protects the pin end of the rod and associated external threads. A box end thread protector is connected to and protects the box end of the coupling and associated internal threads. The thread protectors are designed to prevent damage to the respective rod ends when the rod impacts other objects or is subjected to external impacts. In addition, the thread protectors are designed to seal the ends of the rods so as to reduce the potential for premature corrosion of the threads.

At present, there exist in the market a number of thread and seal protectors having different shapes, forms and functions. A common type of protector comprises a bell-shaped form with internal threads for adaptation to the rod's male adapter, and having a washer installed as an interface between the lower edge of the projector bell and the hydraulic seal surface.

FIG. 1 shows a prior art sucker rod 10. This sucker rod 10 includes a rod 12 having an externally threaded end 14. A thread relief 16 is formed inwardly of the thread 14 and is slightly indented into the outer diameter of the sucker rod 10. A flange 18 extends radially outwardly from an end of the thread relief 16 opposite the external threads 14. Flange 18 serves as an abutment surface when another sucker rod is threadedly affixed to the threads 14 of sucker rod 10.

FIG. 2 shows a thread protector 20 of the prior art. Thread protector 20 is for the pin end of the rod 10 of the prior art shown in FIG. 1. The thread protector 20 has an internal thread 22 for receipt of the pin end and external thread 14 of the sucker rod 10. The thread protector 20 is screwed onto the thread 14 of the sucker rod 10 so as to provide the necessary protection for the sucker rod 10. This process is time-consuming. Hand tools are required to properly carry out this task. Ultimately, the end 24 of thread protector 20 is configured so as to abut the flange 18 of the sucker rod 10 so as to be in somewhat sealing relationship therewith and prevent the intrusion of fluids into the interior of the thread protector 20 and to the external threads 14 of the sucker rod 10.

In the past, various patents have issued for thread protectors for use in association with sucker rods. An early patent is that of U.S. Pat. No. 1,825,605, issued on Sep. 29, 1931 to M. L. Reed. This thread protector has an inner head having two sections which are adjustably connected and which are fixed on an outer end of a T-coupling. An outer head section is removably and swingably secured to the inner head section. A spring is used to force the sections toward each other. An adjustment means for the spring is used so as to engage with a compressible washer pocketed in the outer head section so as to engage with the thread of the sucker rod.

U.S. Pat. No. 2,082,144, issued on Jun. 1, 1937 to D. S. Bowers, also shows a thread protector which has a cup adapted to be sleeved over the ends of a sucker rod. The cup has clamping lugs at one end which are adapted to engage portions of the sucker rod for securing the cap to the rod. A means is interposed between the cup and the sucker rod for sealing the interior of the cup.

U.S. Pat. No. 2,133,049, issued on Oct. 11, 1938 to J. M. Shimer, teaches a thread protector for an externally threaded article. This protector includes a sleeve having an elastic material with a lesser diameter than the threaded portion of the threaded article. The sleeve is adapted to be applied by stretching the sleeve over the threaded portion of the rod. The sleeve is retained in a position solely by its inherent resiliency.

U.S. Pat. No. 2,378,710, issued on Jun. 19, 1945 to E. W. Krause, describes a thread protector for use with the threads of the pipe. This thread protector has a metal shell, a cup-shaped element associated with the shell, and a continuous rolled thread for connection to pipe threads of varying pitch. There is also provided a means for rigidly connecting the shell and the element in telescoping relationship to each other.

U.S. Pat. No. 2,873,765, issued on May 17, 1959 to E. O. Gregory, provides a thread protector for sucker rods of the type having a terminal flange from which a threaded stud projects. The thread protector has a cup-shaped member formed from a flexible, resilient material and having an open outer extremity. The wall of the cup-shaped member has more than two cylindrical portions of decreasing diameter. Each cylindrical portion is adapted to fit over the flange of the sucker rod. Tapered portions join the cylindrical portions to form a continuous wall. A tapered cup portion closes the extremity of the cylindrical portion having the least diameter. The cup portion has a closed bottom. An internally projecting annular locking head is formed in the cup-shaped member adjacent the outer extremity of each cylindrical portion for locking that portion to the sucker rod flange.

U.S. Pat. No. 2,930,118, issued on Mar. 26, 1960 to E. F. Higgins, shows a method of manufacturing a box end thread protector for sucker rod couplings. This method comprises the steps of casting a flanged metal protector body in a mold having a lengthwise parting plane, removing the cast part from the mold, trimming the flash down, stamping the flange in a direction parallel to the axis of the threads, and embossing a continuous annular sealing ridge adjacent the outer portion of the flange. The flange is simultaneously flattened relative to the protector body so as to remove the draft angle.

U.S. Pat. No. 2,930,409, issued on Mar. 26, 1960 to E. F. Higgins, provides a pin end thread protector for sucker rods comprising a cap having a threaded body portion and a closed end. The cap has a skirt having a radius so as to bear against the rod shoulder when the protector is applied to the pin end. The threads of the body portion have a lesser pitch than the threads of the pin end of the rod so the portion of the thread path in contact will be limited. The skirt is compressed upon tightening the protector and further compressed by increasing the temperature thereafter. This compression bears over the portion of the helical path of the thread that it is in contact with. The relative expansion of the protector upon heating causes an increase of the thread path area in contact and thereby effectively tightening the grasp of the protector at an elevated temperature.

U.S. Pat. No. 5,813,104, issued on Sep. 29, 1998 to T. W. Quick, teaches a sucker rod thread protector removal tool. This patent teaches that there is a frusto-conical thread protector on the pin end portion of a sucker rod. This thread protector is removed by a cylindrical housing axially surrounding, at one end portion, the thread protector and the adjacent end portion of the sucker rod. A stop is diametrically mounted on the periphery of the tubular housing at the sucker rod end portion and projects inwardly of the housing wall in confronting relation to abut the large diameter open end of the thread protector for removing the thread protector from the sucker rod in response to a plunger axially projecting into the housing opposite the sucker rod and forcibly move longitudinally to pierce the wall at the small end of the thread protector.

U.S. Pat. No. 6,474,411, issued on Nov. 5, 2002 to A. G. Carrano-Castro, provides a metal protector for the threaded extremities of well drilling tubes. The protector is intended to protect the threads and seals of the assembly joint during transportation and handling in the wells.

It is an object of the present invention to provide a thread protector which fits the pin end of a sucker rod or a drill pipe.

It is another object the present invention provide a thread protector that does not utilize the threads of the sucker rod as the main anchoring area.

It is still another object of the present invention to provide a thread protector which fits securely over the thread of the threaded end of the sucker rod.

It is still another object of the present invention to provide a thread protector which does not require screwing or unscrewing from the rod.

It is still another object of the present invention to provide a thread protector that can be quickly and easily installed and released.

It is still a further object of the present invention to provide a thread protector which is easy to manufacture and relatively inexpensive.

These and other objects and advantages of the present invention will become apparent from a reading of the attached specification and appended claims.

BRIEF SUMMARY OF THE INVENTION

The present invention is a thread protector for use on a sucker rod or tool. The sucker rod or tool has at least one externally threaded end and a thread relief adjacent to the externally threaded end. The thread protector comprises a collet having a plurality of collet segments in which each of the plurality of collet segments has a protrusion adjacent to an end thereof, and a sleeve overlying the collet and movable between a first position and a second position. The second position compresses the plurality of collet segments such that the protrusion engages with the thread relief of the sucker rod or drill pipe.

The collet has a main body portion. The plurality of collet segments extend outwardly of the main body portion. The sleeve overlies the main body portion when in the first position. The collet has an interior cavity adapted to receive the end of the sucker rod therein. The main body portion preferably has an O-ring positioned in a groove formed therein. The protrusion has an inner portion and an outer portion. The inner portion of the protrusion protrudes inwardly from an inner surface of the collet segment. The outer portion of the protrusion protrudes outwardly of an outer surface of the collet segment. The protrusion is formed of an end of the collet segment opposite the main body portion. Each of the plurality of collet segments is of a generally constant thickness extending between the main body portion and the protrusion. The main body portion has a shoulder formed at an outer surface thereof. The sleeve resides against the shoulder in the first position.

The sleeve has a first section overlying an outer surface of the main body portion. The first section of the sleeve has an inner diameter slightly greater than an outer diameter of the main body portion. The sleeve has a second section extending from the first section. The second section has an inner diameter greater than the inner diameter of the first section. The second section overlies the plurality of collet segments. The inner diameter of the second section is less than an outer diameter of the collet at the area of the protrusions. The sucker rod has a flange formed to the side of the thread relief opposite the threads. The sleeve has a third section having an inner diameter greater than the inner diameter of the second section. The third section overlies the flange when the sleeve is in the second position. The inner diameter at the third section is preferably smaller than the outer diameter of the flange. The protrusion has an inner surface having a curvature conform to a curvature of the thread relief.

The present invention is a threadless thread protector having a collet and a sleeve. The present invention makes use of the standard thread relief at the end of the external thread of the rod as a means of a fixing the thread protector to the rod. The thread relief is the cylindrical portion of the sucker rod or drill pipe having a diameter smaller than the diameter of the adjacent external threads.

The thread protector is assembled by inserting the collet into the sleeve and then snapping it into place. The thread protector of the present invention can be set and unset by hand. By pulling the sleeve all the way into the collet edge, the sleeve loosens the collet so that snapping under the thread relief is possible. Once the thread protector is extended all the way over the thread, the sleeve is pulled away from the initial position and twisted 90° in order to offset the tabs and notches, to lock in place, and to avoid falling off.

In an alternative embodiment, the present invention is also a thread protector for use on a sucker rod or a tool. The sucker rod or tool has at least one externally threaded end, a threaded relief adjacent the externally threaded end, and a flange. The thread protector includes a sleeve with an open end and a closed end. The sleeve has a first portion adjacent to the closed-end. The first portion is adapted to receive the externally threaded end of the sucker rod or tool. A first protrusion is formed adjacent the first portion of the sleeve. The first protrusion is adapted to snap into the threaded relief of the sucker rod or tool. A second protrusion is formed adjacent the open end of the sleeve. The second protrusion has an inner diameter smaller than an outer diameter of the flange. The second protrusion forms a seal between the sleeve and the sucker rod or tool. The closed end of the sleeve preferably has a grip portion for ease-of-use of the protector.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
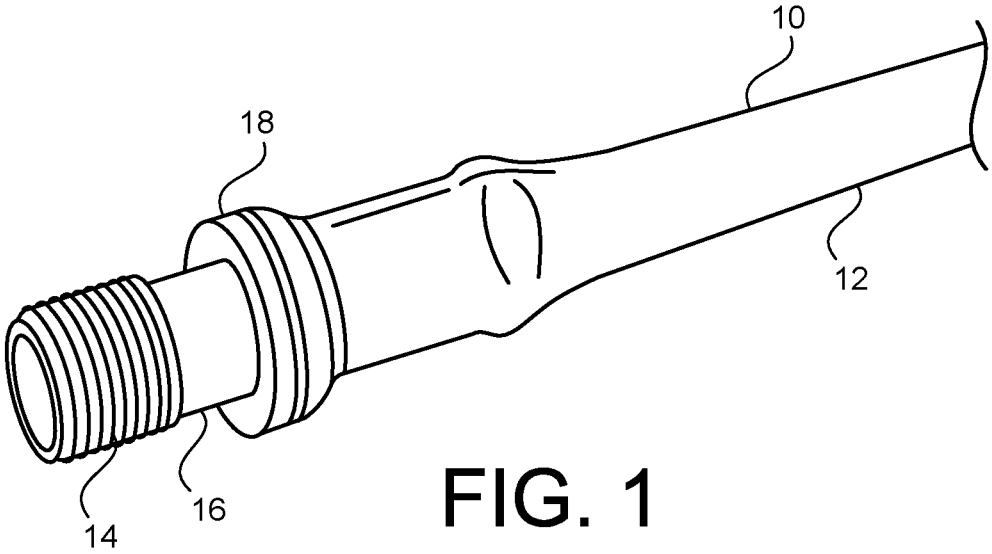
FIG. 1 PRIOR ART
FIG. 1 is a perspective view of a sucker rod of the prior art showing, in particular, the externally threaded end of the sucker rod.
Figure 2:
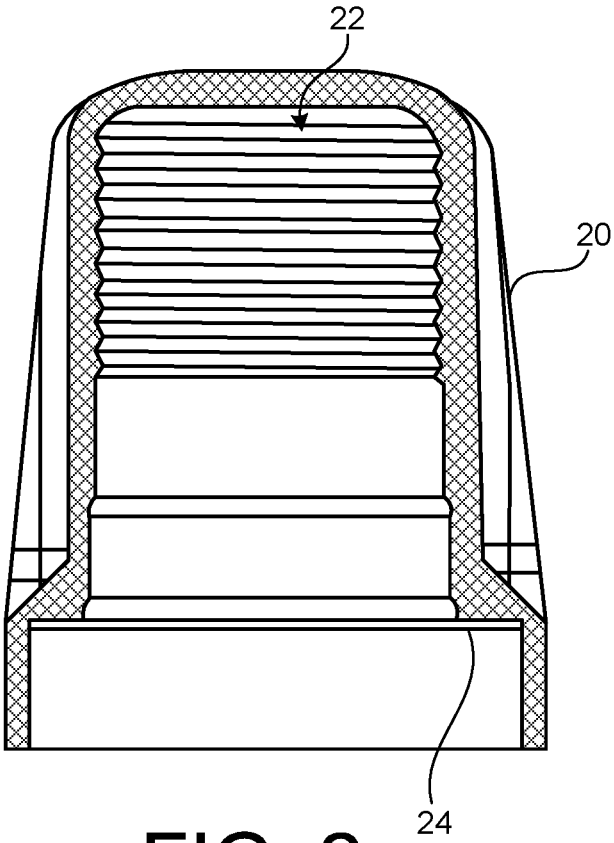
FIG. 2 PRIOR ART
FIG. 2 is a cross-sectional view of a prior art thread protector.
Figure 3:
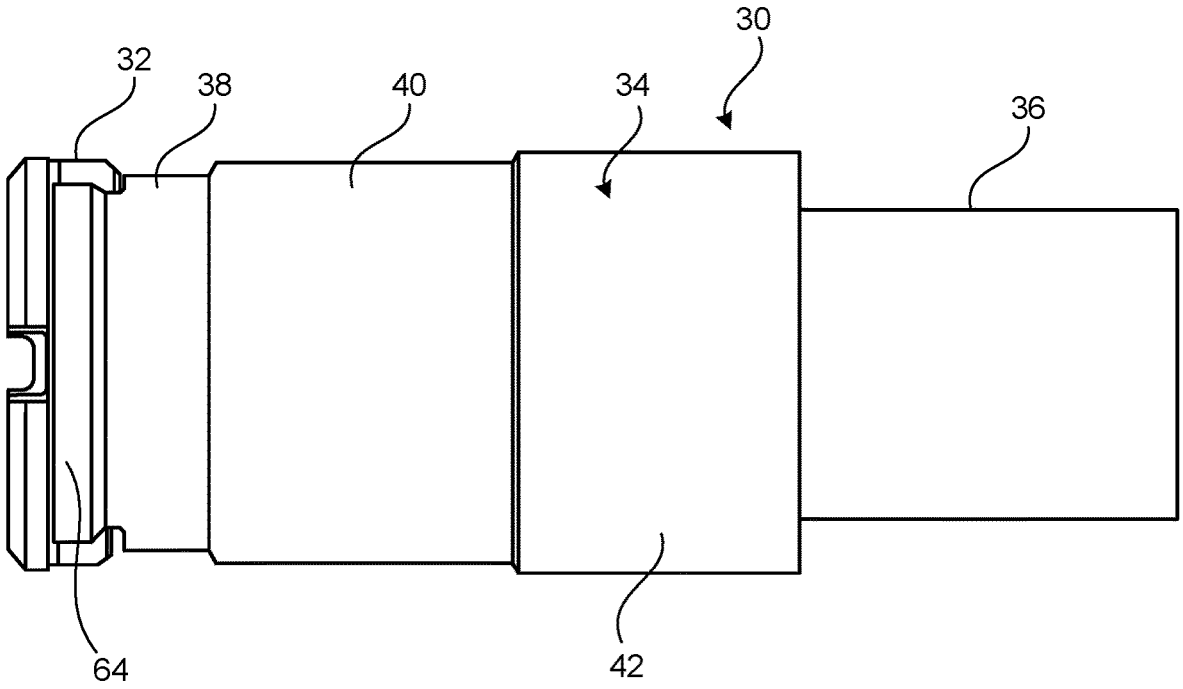
FIG. 3 is a side elevational view of the thread protector of the present invention as applied over the end of the sucker rod.

FIG. 3 shows the thread protector 30 in accordance with the preferred embodiment of the present invention. The thread protector 30 includes a collet 32 and a sleeve 34 extending over the collet 32 and over the exterior of the sucker rod or oil tool 36. In particular, in FIG. 3, the collet 32 includes a main body portion (shown in FIG. 4 as reference number 35) of a generally cylindrical shape that is adapted to receive the threaded end of the sucker rod 36 therein. The sleeve 34 is configured so as to be positioned over this main body portion.

The sleeve 34 includes a first section 38 which extends over the outer diameter of the main body portion of the collet 32. As will be described hereinafter, the inner diameter of the first section 38 will be only slightly greater than the outer diameter of the main body portion so that the first section 38 can slide with respect to the outer diameter of the main body portion. A second section 40 extends from the first section 38 and has an outer diameter greater than the outer diameter of the first section 38. A third section 42 extends from the second section 40 and has an outer diameter which is greater than the outer diameter of the second section 40. Generally, the third section 42 will reside over the flange 56 of the sucker rod 36.

Figure 4:
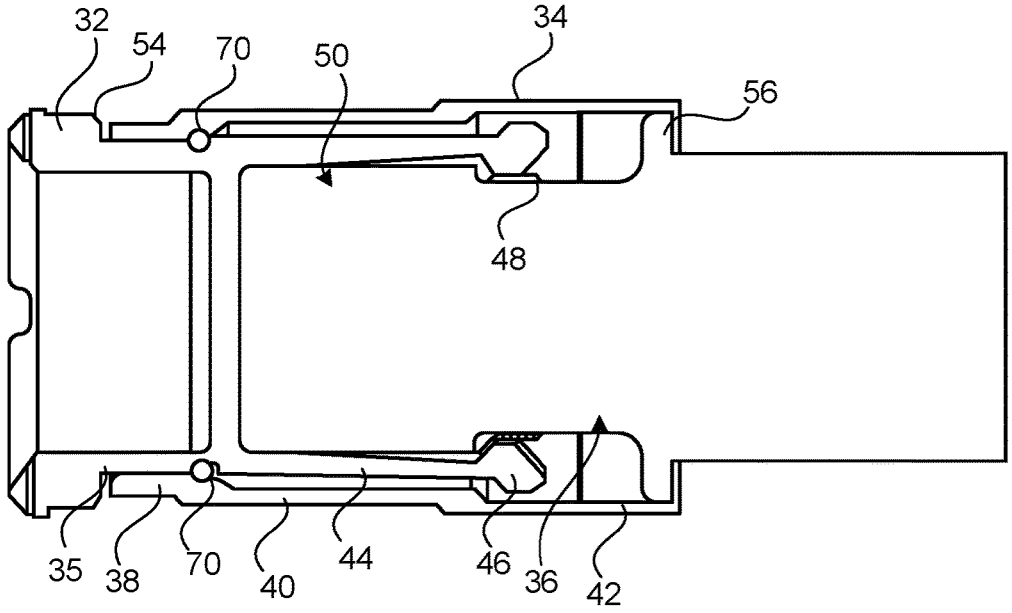
FIG. 4 is a cross-sectional view showing the thread protector of the present invention as applied over the threads of the sucker rod in which the sleeve is in a first position.

FIG. 4 shows the internal configuration of the collet 32 with respect to the sleeve 34. The collet 32 has the main body portion 35 extending outwardly therefrom. The sleeve 34 is shown in its first position in which the plurality of collet segments 44 of collet 32 are flexed outwardly. This outward flex is the natural orientation of the plurality of collet segments 44 when not under pressure or tension. Each of the plurality of collet segments 44 includes a protrusion 46. It can be seen that protrusion 46 is located in the area of the thread relief 48 beyond the externally threaded end 50 of the sucker rod 36.

In FIG. 4, it can be seen that the sleeve 34 has an end generally adjacent to the shoulder 54 of the main body portion 35 of collet 32. As such, when the sleeve 34 is in this retracted position, no or minimal pressure is applied to the outer surfaces of either the plurality of collet segments 44 and the protrusions 46 by the interior surfaces of the sleeve 34.

The first section 38 of sleeve 34 is illustrated as having an inner diameter only slightly greater than the outer diameter of the main body portion 35 of collet 32. The collet segments 44 extend outwardly from the main body portion 35. The interior of the plurality of collet segments 44 form an area for the receipt of the externally threaded end 50 of the sucker rod 36.

The second section 40 of the sleeve 34 extends from the first section 38. The second section 40 has an inner diameter that is greater than the outer diameter of the plurality of collet segments 44 and also greater than the inner diameter of the first section 38. The third section 42 of the sleeve 34 is illustrated as having an inner diameter greater than the outer diameter of the plurality of protrusions 46. The inner diameter of the third section 42 is preferably slightly smaller than the outer diameter of the flange 56 of the sucker rod 36, which creates an interference fit and forms a seal.

In this initial installation procedure, the plurality of collet segments 44, along with the sleeve 34, can be placed over the externally threaded end 50 of the sucker rod 36. This insertion procedure can continue until the end of the third section 42 of the sleeve 34 overlies the flange 56. As such, it can be assured that the threaded end 50 is properly nested within the interior of the collet 32 and interior of the plurality of collet segments 44. In order to lock the collet 32 over the externally threaded end 50 of the sucker rod 36, it is only necessary to push the sleeve 34 away from the main body portion 35 of the collet 32 in a direction toward the flange 56 of the sucker rod 36. This will lock the plurality of collet segments 44 and associated protrusions 46 in a position within the thread relief 48 of the sucker rod 36.

FIG. 4 also shows an O-ring-70 provided on the collet 32. The O-ring 70 is positioned in a groove formed in the main body portion 35 of the collet 32. Preferably, the O-ring 70 and groove are positioned slightly inwardly of the plurality of protrusions 46 of the collet 32. The O-ring 70 is compressible and abuts the inner diameter of the sleeve 34. The O-ring 70 provides for an interference fit and seal between the collet 32 and the sleeve 34. Further, the O-ring 70 provides a resistance between the collet 32 and the sleeve 34 which provides for easy installation of the thread protector of the present invention. In other embodiments, the O-ring 70 could be provided on the inner surface of the sleeve 34.

Figure 5:
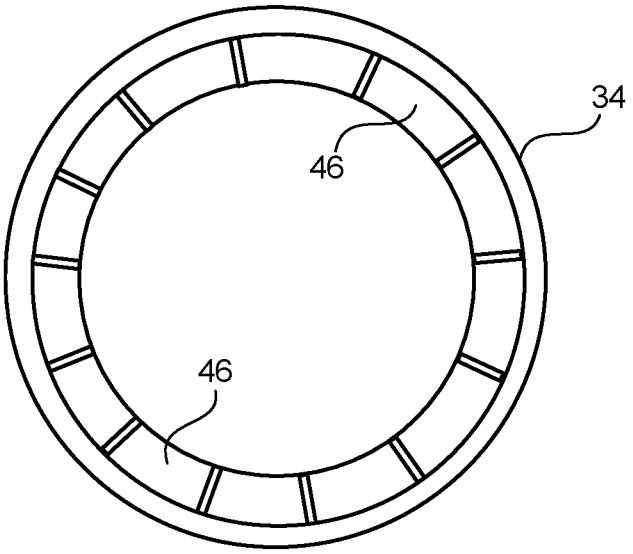
FIG. 5 is a cross-sectional end view of the thread protector of the present invention showing, in particular, the sleeve as compressing the collet segments.

FIG. 5 shows this locked configuration of the sleeve 34 over the protrusions 46 of the plurality of collet segments 44. The protrusions 46 are compressed together so that the sides of each of the protrusions 46 will be closely positioned against each other and so as to extend around the thread relief 48 of the sucker rod 36.

Figure 6:
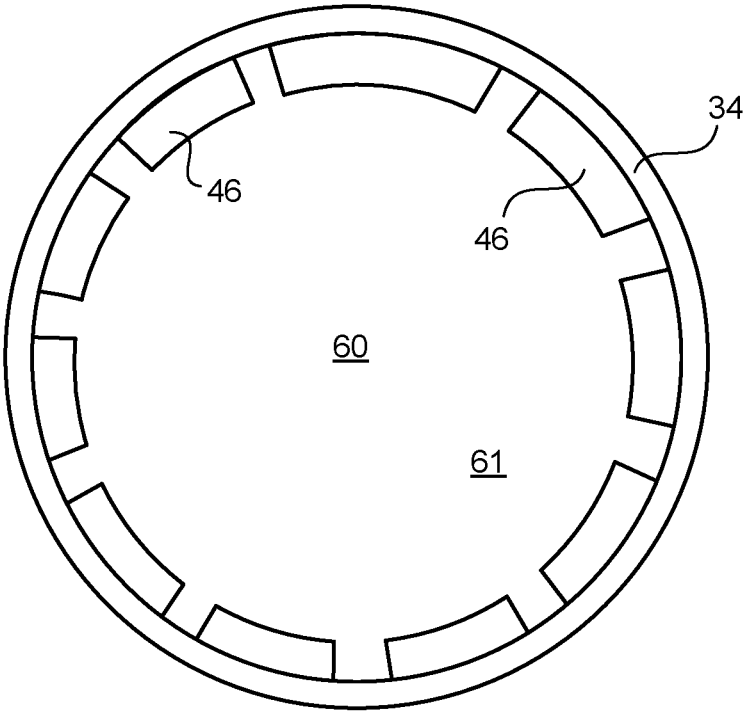
FIG. 6 is a cross-sectional end view showing the sleeve as releasing the plurality of collet segments and for the release of the sucker rod from the thread protector.

FIG. 6 shows the separation of the protrusions 46 that results from the rearward movement of the sleeve 34. As can be seen, each of the plurality of collet segments 44 will move outwardly so as to correspondingly flex the protrusions 46 outwardly. As such, since the plurality of collet segments 46 are generally spaced further away from each other, this will create a wider opening 60 to the cavity 61 therein. As such, the externally threaded end 50 of the sucker rod 36 can be easily removed from the thread protector.

Figure 7:
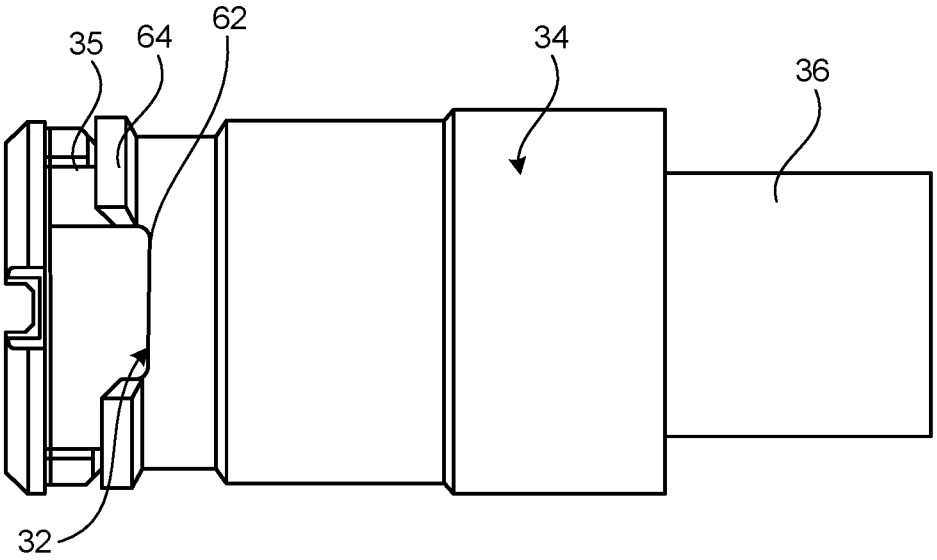
FIG. 7 is a side elevational view of the thread protector of the present invention with the sleeve in a second position for locking the thread protector onto the threads of the sucker rod.

FIG. 7 shows the thread protector 30 of the present invention wherein the sleeve 34 has been moved away from the collet 32. As can be seen, this movement of the sleeve 34 exposes more of the main body portion 35 of the collet 32. When shifting the sleeve 34 in place, a 90° twist of the collet 32 relative to the sleeve 34 can be utilized. This twisting locates the tabs 61 of the collet 32 in line with the notches 62 of the sleeve 34, and away from the flange elements 64 of the sleeve 34. This prevents the sleeve from traveling to the unlocked position.

Figure 8:
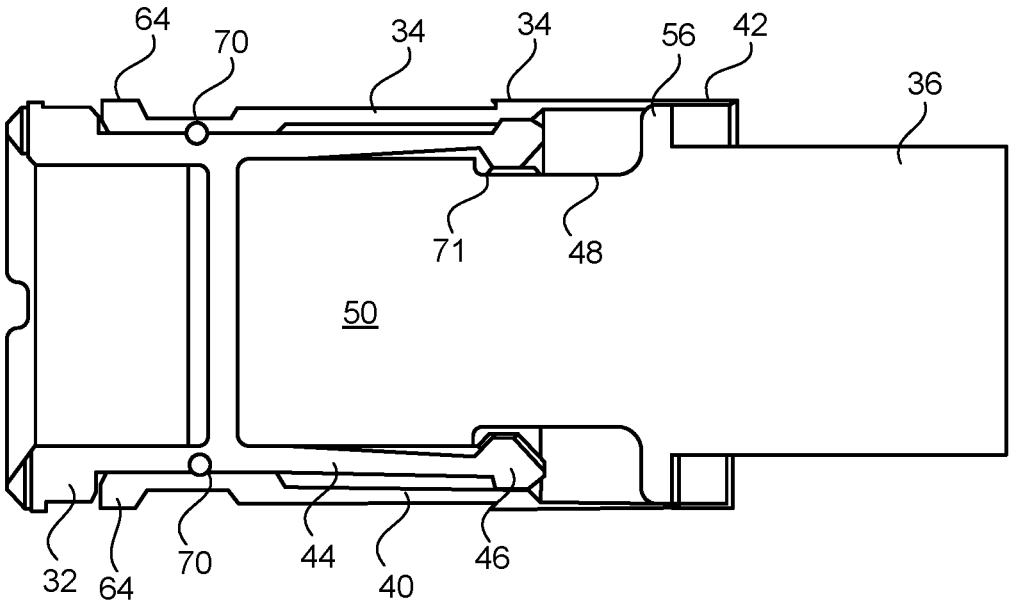
FIG. 8 is a cross-sectional view of FIG. 7 showing, in particular, the locking of the collet segments onto the thread relief of the sucker rod.

FIG. 8 shows the sleeve 34 in its extended position. In this extended position, the second section 40 of the sleeve 34 will abut the outer surface of the protrusion 46 so as to compress the collet segment 44 and the protrusion 46 inwardly. As such, the inner surface of the protrusion 46 will engage with the curvature 71 of the thread relief 48. This locks the collet 32 in the position over the externally threaded end 50 of the sucker rod 36. The third section 42 of sleeve 34 extends so as to overlie the flange 56 of sucker rod 36. In this configuration, the sleeve 34 and the collet 32 is locked over the externally threaded end 50 for protection. The present invention provides for a fluid tight fit, due in part to the O-ring 70 and the interference fit between the various components of the thread protector. The overlying relationship of the third section 42 of the sleeve 34 and the flange 56 provides further fluid resistance by interference fit.

Figure 9:
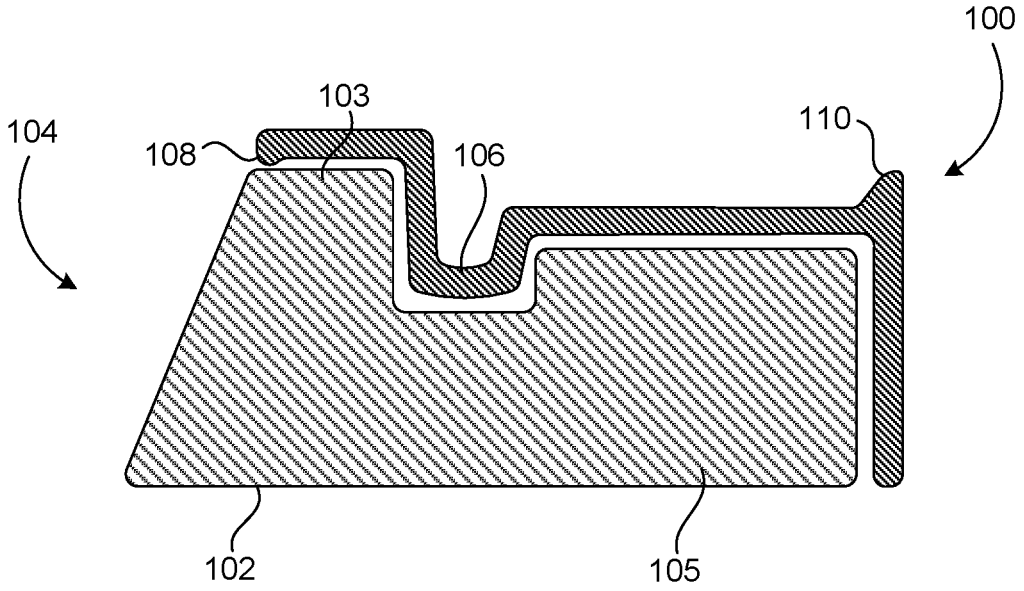
FIG. 9 is a cross-sectional view of an alternative embodiment of the thread protector of the present invention.

Referring to FIG. 9, there shown an alternative embodiment of the thread protector 100 of the present invention. The thread protector 100 is shown as being positioned over the end of a sucker rod or tool 102. The sucker rod or tool 102 has an externally threaded end 105 and a flange 103.

The thread protector 100 comprises a sleeve having an open end and a closed end, and interior 104. The sleeve of the thread protector 100 has a first protrusion 106. The first protrusion 106 is received in a seat in the sucker rod or oil tool 102, and locks the thread protector 100 against the sucker rod or tool 102.

The thread protector 100 additionally includes a second protrusion 108. The second protrusion 108 and has an inner diameter which is slightly smaller than the outer diameter of the flange 103. As such, the second protrusion 108 maintains an interference fit against the flange 103, and seals the thread protector 100 against the sucker rod or tool 102.

A grip 110 is also provided on the closed end of the thread protector 100. This enables the thread protector 100 to be easily pushed on or pulled off of the sucker rod or oil tool 102. The thread protector 100 of the alternative embodiment of the present invention is formed of a semi-flexible material such that it can be easily snap on and pulled out of position on the sucker rod or oil tool 102.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A thread protector for use on a sucker rod or tool, the sucker rod or tool having at least one externally threaded end and a thread relief adjacent the externally threaded end, the thread protector comprising:

a collet having a plurality of collet segments, each of said plurality of collet segments having a protrusion adjacent an end thereof; and a sleeve overlying said collet and movable between a first position and a second position, the second position compressing the plurality of collet segments such that the protrusions engage with the thread relief of the sucker rod or drill pipe, said sleeve having a first section overlying an outer surface of said main body portion, said first section of said sleeve having an inner diameter slightly greater than an outer diameter of said main body portion, said sleeve having a second section extending from said first section, said second section having an inner diameter greater than the inner diameter of said first section, said second section overlying said plurality of collet segments, the sucker rod or drill pipe having a flange formed at a side of the thread relief opposite the thread, said sleeve having a third section having an inner diameter greater than the inner diameter of said second section, said third section overlying the flange when said sleeve is in the second position, said inner diameter of said third section being smaller than an outer diameter of said flange.

2. The thread protector of claim 1, said collet having a main body portion, said plurality of collet segments extending outwardly of said main body portion.

3. The thread protector of claim 2, said sleeve overlying said main body portion when in the first position.

4. The thread protector claim 2, said collet having an interior cavity adapted to receive the end of the sucker rod or drill pipe therein.

5. The thread protector claim 2, said protrusion being formed at an end of the collet segment opposite the main body portion.

6. The thread protector claim 2, said main body portion having a shoulder formed at an outer surface thereof, said sleeve residing against said shoulder in the first position.

7. The thread protector claim 2, said main body portion of said collet having an O-ring positioned in a groove formed therein.

8. The thread protector of claim 1, the protrusion having an inner portion and an outer portion, the inner portion of the protrusion protruding inwardly of an inner surface of the collet segment, said outer portion of the protrusion protruding outwardly of an outer surface of the collet segment.

9. The thread protector of claim 1, the inner diameter of said second section being less than an outer diameter of said collet at the protrusions.

10. A protector assembly comprising:

a sucker rod having an external thread at an end thereof and a thread relief adjacent to the external thread, said sucker rod having a greater outer diameter at the external thread than at the thread relief;

a collet having a plurality of collet segments, each of said plurality of collet segments having a protrusion adjacent an end thereof; and a sleeve overlying said collet and rotatable between a first position and a second position, the second position compressing said plurality of collet segments such that the protrusion engages with the thread relief of said sucker rod.

11. The protector assembly of claim 10, said collet having a main body portion, said plurality of collet segments extending outwardly of said main body portion.

12. The protector assembly of claim 11, said sleeve overlying said main body portion when in the first position.

13. The protector assembly of claim 11, said main body portion having a shoulder formed at an outer surface thereof, said sleeve residing against said shoulder when in the first position.

14. The protector assembly of claim 11, said main body portion of said collet having an O-ring positioned in a groove formed therein.

15. The protector assembly of claim 11, said sleeve having a first section overlying an outer surface of said main body portion, said first section of said sleeve having an inner diameter slightly greater than an outer diameter of said main body portion, said sleeve having a second section extending from said first section, said second section having an inner diameter greater than the inner diameter of said first section, said second section overlying said plurality of collet segments.

16. The protector assembly of claim 15, the inner diameter of said second section being less than an outer diameter of said collet at the protrusions thereof, said sucker rod having a flange formed to the side of said thread relief opposite said thread, said sleeve having a third section having an inner diameter greater than the inner diameter of said second section, said third section overlying the flange when said sleeve is in the second position.

17. The protector assembly of claim 10, the protrusion of said collet having an inner portion and an outer portion, said inner portion protruding inwardly of an inner surface of the collet segment, said outer portion protruding outwardly of an outer surface of the collet segment.

* * * * *